United States Patent [19]

Creswick

[11] Patent Number: 5,027,577

[45] Date of Patent: Jul. 2, 1991

[54] AUTO COMPENSATING FOIL POUCH DETECTOR

[75] Inventor: Norman S. Creswick, Wyckoff, N.J.

[73] Assignee: Thomas J. Lipton Company, Englewood Cliffs, N.J.

[21] Appl. No.: 536,964

[22] Filed: Jun. 12, 1990

[51] Int. Cl.[5] ..... B65B 57/10

[52] U.S. Cl. ..... 53/53; 53/77; 53/171; 324/226; 324/229

[58] Field of Search ..... 53/53, 52, 54, 455, 53/562, 171, 170, 77; 209/567; 324/228, 229, 230, 226, 227, 239, 243, 671

[56] References Cited

U.S. PATENT DOCUMENTS

| | | | |
|---|---|---|---|
| 1,983,388 | 12/1934 | Moore | 324/226 X |
| 2,982,862 | 5/1961 | Smith | 324/226 X |
| 2,989,179 | 6/1961 | Woods et al. | 209/72 |
| 2,990,952 | 7/1961 | Nigrelli et al. | 209/72 |
| 3,003,627 | 10/1961 | Sorbie | 209/71 |
| 3,165,726 | 1/1965 | Riley et al. | 324/229 X |
| 3,409,129 | 11/1968 | Sperry | 324/226 X |
| 3,415,369 | 12/1968 | Hennig | 53/53 X |
| 3,440,432 | 4/1969 | Justus | 53/498 X |
| 3,572,502 | 3/1971 | Quinn et al. | 209/73 |
| 3,869,663 | 3/1975 | Tschierse | 324/226 |
| 3,956,869 | 5/1976 | Slathar et al. | 53/53 |
| 4,545,179 | 10/1985 | Rebsamen et al. | 53/443 |
| 4,945,714 | 8/1990 | Bodolay et al. | 53/562 X |

*Primary Examiner*—James F. Coan

*Attorney, Agent, or Firm*—Brumbaugh, Graves, Donohue & Raymond

[57] ABSTRACT

For use with automatic machinery for packaging a food product in foil pouches and then inserting a desired number of pouches in a box, a method and apparatus for scanning the boxes to check for missing pouches. The scan is accomplished by applying like alternating magnetic fields through each box and through the foil used to make the pouches at a point upstream from where the pouches are formed. Detected field absorption associated with the upstream foil is used as a reference, and the difference between it and detected field absorption associated with a box is proportional to the number of pouches in the box. The apparatus can detect if one out of two, one out of three, or one out of four is missing, and compensates the differential signal for variations in foil thickness by multiplying the reference signal by N−1, where N is desired pouch count per box. If a pouch is missing from a box, a signal is generated which can be used to trigger a rejection mechanism to remove the short-count box.

8 Claims, 3 Drawing Sheets

AUTO COMPENSATING FOIL POUCH DETECTOR

BACKGROUND OF THE INVENTION

This invention relates to a method for producing boxes of foil pouches containing a product, such as a dry food product, wherein each box is to contain a prescribed number of pouches. The invention also relates to a system for implementing the above method.

In known machines for packaging dry food products such as soup mixes, for example, in foil pouches, an elongate strip of foil, typically a plastic, paper and foil laminate, is drawn over and folded by a plow to form a U-shaped trough open at the top, the confronting layers of foil are then heat-sealed at spaced locations along the length and then severed along the seal lines to form individual pouches each closed at the bottom and sealed along vertical side edges. The empty pouches are transported along a path beneath a succession of hoppers from which measured quantities of different ingredients are dispensed, and then to sealing apparatus at which the open top of the filled pouch is heatsealed. A specified number of pouches are inserted in a box in which the product is to be retailed, the number being determined by the nature of the product; typically, each box may contain two, three or four pouches, although for some products there may be only one pouch per box. After the specified number of pouches have been inserted, the box is automatically sealed and transported to a carton for storage and shipment.

For obvious marketing reasons no short count boxes are permitted, and in order that the consumer not be given more than for which he or she has paid a box should not contain more than the specified number of pouches. In the known Peco system for detecting whether a pouch is missing from a box intended to contain two foil pouches, an alternating magnetic field is applied through each box and the detected output, which is a measure of the field absorbed by the foil pouches contained in the box, is balanced against a DC reference voltage. This system is only capable of detecting whether one out of two pouches is missing from a box, and produces correct results only for the foil thickness to which it is initially balanced; consequently, not uncommon variations in foil thickness cause erroneous results. Also, because the Peco system is single-ended, it is unable to detect one pouch missing from a box which is supposed to contain three or four pouches.

SUMMARY OF THE INVENTION

It is an object of the present invention to solve the problem of insuring that the number of boxed pouches specified on the outside of the box are indeed contained in the box.

A more specific object of the invention is to provide a method and apparatus for detecting whether a pouch is missing from a box which is supposed to contain two, or three, or four foil pouches containing a food product or the like.

The method according to the invention is adapted to be used with known apparatus for automatically producing sealed boxes containing a specified number of food-containing foil pouches wherein the foil pouches are formed at a first station, are carried past a succession of hoppers each of which dispenses into each a measured amount of a different ingredient and are then sealed. A specified number of filled pouches are automatically inserted in a retail-size box, the box is sealed and then transported to and inserted in a carton for storage and shipment. The method according to the invention includes the step of applying a magnetic field to the folded foil at a point upstream from the pouch forming station and also to each sealed box and measuring the difference between the field absorbed by two thicknesses of the foil, which is used as a reference, and the field absorbed in the box, which is proportional to the number of pouches inside. Detection of one missing pouch out of two, one out of three or one out of four, is accomplished by compensating the differential signal for foil thickness changes by multiplying the reference signal by $(N-1)$ where N is the specified pouch count. If a pulse is missing a signal is generated for triggering a rejection mechanism to remove the box before it reaches the shipping carton.

An apparatus for implementing the above method includes at least two transmitters, one at a point upstream of the pouch forming station and one or more downstream of the box-sealing station for respectively applying an alternating magnetic field through two thicknesses of foil and through a box of filled pouches, and a receiver associated with each transmitter for detecting the field transmitted by the two thicknesses of foil and the field transmitted by the boxed pouches. Using as a reference the signal representing the field transmitted by the two thicknesses of foil, a comparator circuit measures the difference between this signal and the signal measured at the box to produce an output signal proportional to the number of pouches in the box. The circuit automatically compensates for variations in foil thickness, making it possible for the user to select the number of pouches to be contained in each box and the system automatically to generate a rejection signal when the reference signal and the boxed product signal are unequal.

Other objects, features and advantages of the invention, and a better understanding of its construction and operation, will be had from the following detailed description, taken in conjunction with the accompanying drawings.

DESCRIPTION OF THE PREFERRED EMBODIMENT

Figure 1:
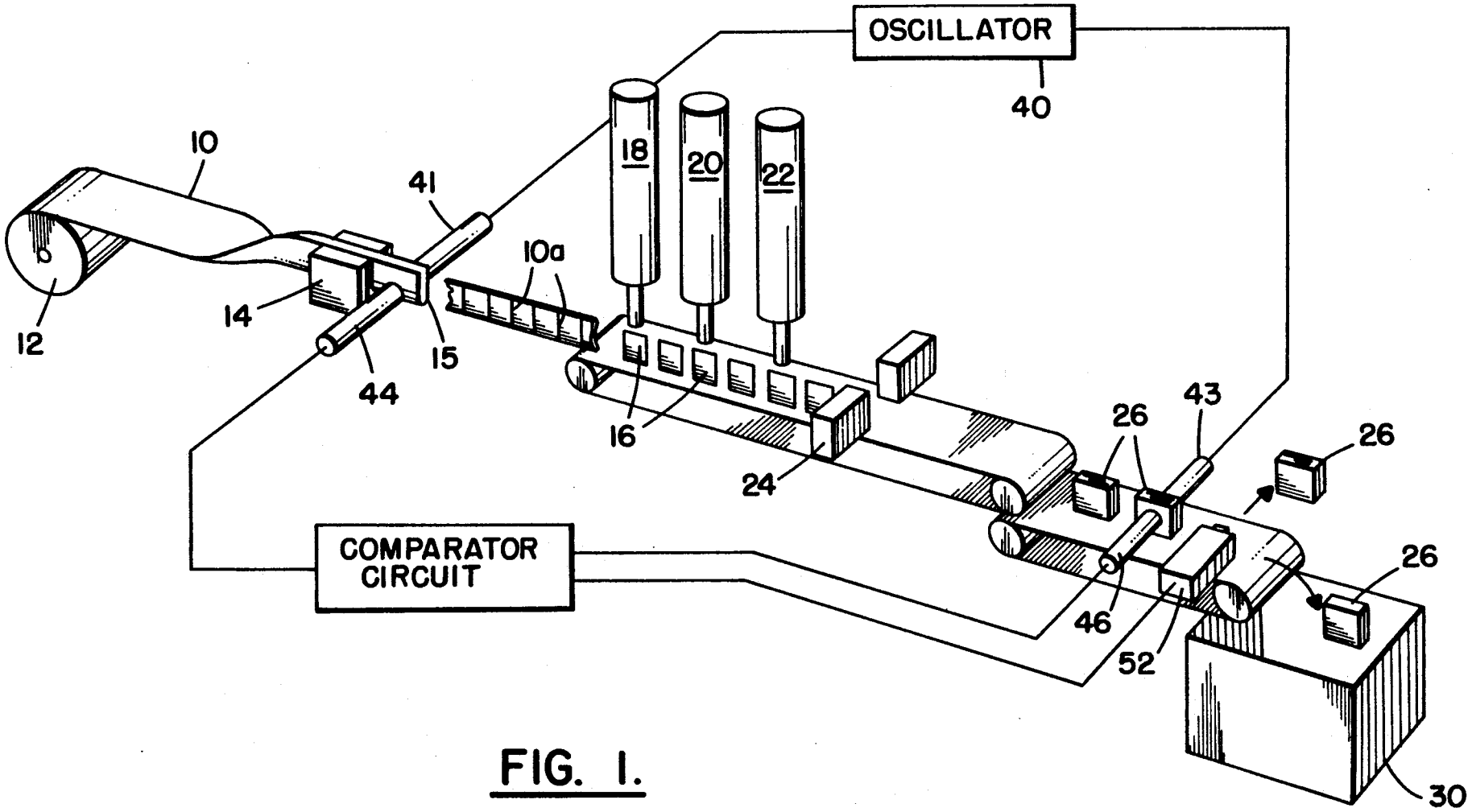
FIG. 1 is a schematic perspective view showing those operations of a food-packaging system essential to an understanding of the method and apparatus of the invention.

Referring to FIG. 1, the method and apparatus of the present invention is adapted to be used in association with known automatic food packaging machinery of the type in which a sheet 10 of paper, plastic, foil laminate, typically $0.8\times10^{-5}$ meters thick, is drawn from a roll 12 and folded along its longitudinal center line with a plow 14 of known construction to form a U-shaped trough 15 open at the top. The two confronting layers are then heat sealed with a sealing device 11 of known construction along vertical lines 10*a* spaced along the direction of movement of the foil by the desired width of the pouch and then severed along the seal line to form individual open-top pouches 16 each closed at the bottom and sealed along vertical side edges. Empty pouches are transported in close succession past a plurality of hoppers 18, 20 and 22, at each of which a measured amount of a different ingredient (of a dried soup mix, for example) is dispensed into the pouch by gravity, after which the top of the pouch is sealed with a heat-sealing device 24 of conventional construction. A desired number of the sealed pouches are then automatically inserted into a box 26 of the kind that appear on grocers' shelves, the machine including means (not shown) for inserting the specified number before it seals the box. For marketing reasons, largely dependent on the nature of the product, the number of pouches per box typically is two, three or four. After they are sealed the boxes are transported by a suitable conveyor 28 to and placed in a carton 30 for storage and shipment.

Figure 2:
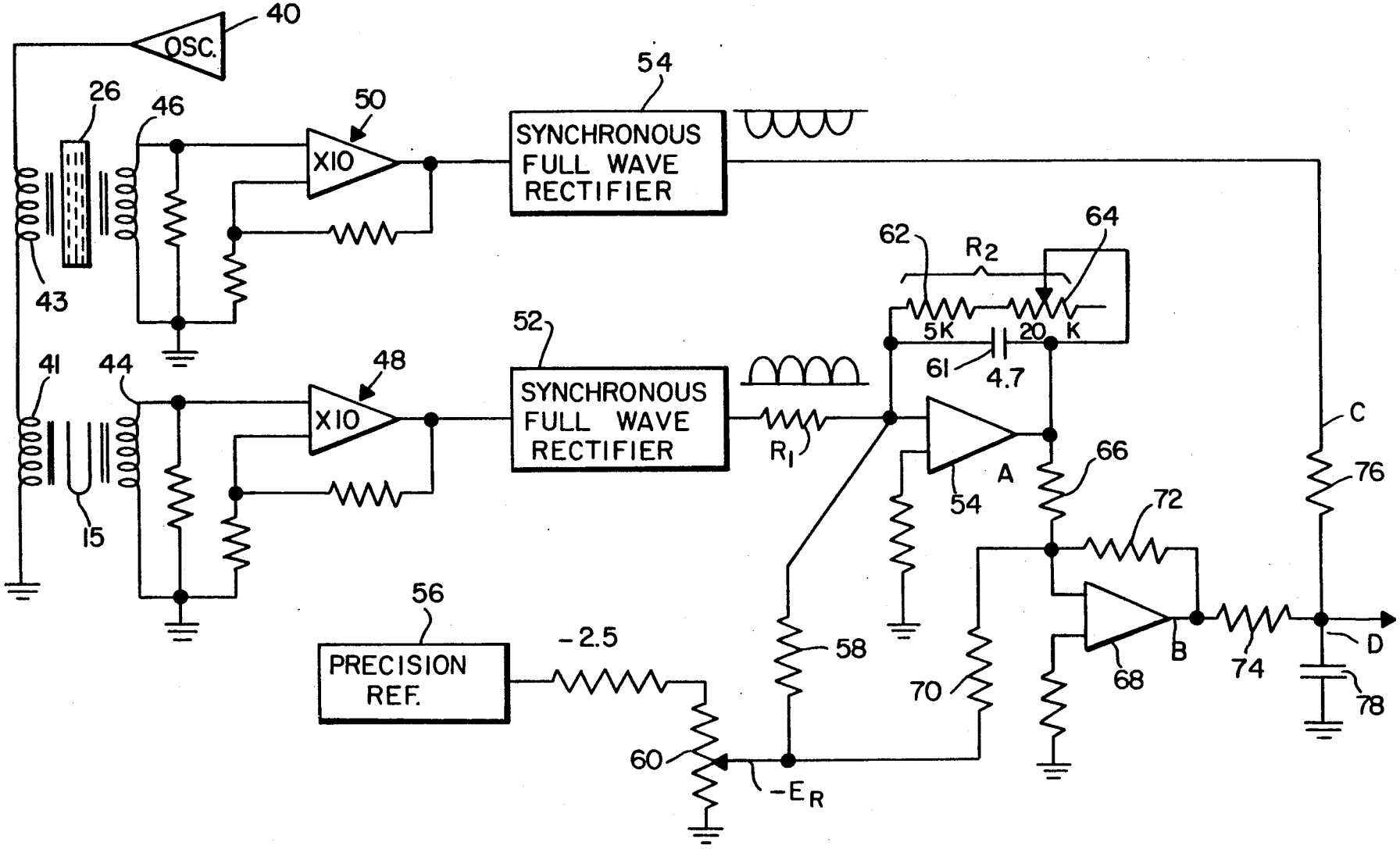
FIG. 2 is a schematic circuit diagram of a pouch detection system according to the invention.

The present invention, the purpose of which is to ensure that each box as sealed and packaged for shipment contains the correct number of pouches, includes an oscillator 40 typically having a frequency of 20 KHz, coupled to a pair of transmitters 42 and 44 located upstream of the pouch-forming station and immediately following the boxsealing station, respectively, each essentially comprising induction coils 41 and 43, respectively, (FIG. 2) for applying an alternating magnetic field to the folded foil used to make the pouches and to a box 26 containing filled pouches. As schematically shown in FIG. 2, both the folded foil trough 15 and the filled box are so oriented that the magnetic field traverses two foil thicknesses per pouch. That portion of the radiation not absorbed by the double thickness trough 15 and the boxed pouches induces voltages in associated induction coils 44 and 46, respectively, the amplitudes of which are proportional to the transmission of the two paths. The voltages induced in coils 44 and 46 are amplified in respective operational amplifiers 48 and 50 and their outputs rectified by respective synchronous full-wave rectifiers 52 and 54 which respectively produce a DC output signal ($E_F+\Delta E_F$), where $\Delta E_F$ is a signal component due to variations in the thickness of the foil being used to make the pouches, and a DC output signal of opposite polarity at point "C", the amplitude of which is proportional to the number of pouches contained in box 26.

The circuit continuously compares the signal appearing at point "C" with the signal ($E_F+\Delta E_F$) multiplied by the factor (N−1), where N is the specified pouch count per box, and if the number of pouches in the box is other than N, generates a signal which can be used to trigger a rejection mechanism 52 (FIG. 1) for removing the short count box from the conveyor before it reaches the shipping carton 30. The comparison is accomplished by applying the pouch only signal ($E_F+\Delta E_F$) to the inverting input of an operational amplifier 54 via a resistor $R_1$, typically having a value of 5K ohms, and applying to the same input a D.C. reference voltage, $-E_R$, derived from a precision reference voltage source 56 delivering a voltage of −2.5 volts. The amplitude of the reference D.C. voltage applied to operational amplifier 54, via a resistor 58 having a value of 5K ohms, may be varied by adjusting the position of the wiper of a potentiometer 60 connected between the output terminal of source 56 and ground. Operational amplifier 54 includes a feedback network comprising a capacitor 61, typically having a value of 0.47 microfarads, connected in parallel with a resistor $R_2$ consisting of a fixed 5K ohm resistor 62 connected in series with a potentiometer 64 having a maximum resistance of 20K ohms.

The signal appearing at point "A" is applied via a resistor 66, typically having a value of 5K ohms, to the inverting input of a second operational amplifier 68, to which the DC reference voltage $-E_R$ is also applied via a 5K ohm resistor 70. The feedback resistor 72 of operational amplifier 68 also has a value of 5K ohms.

With no foil in either the reference gap or the box gap, the voltage at the output terminal "A" of the first operational amplifier, namely, $$A=-R_2/R_1[(E_F+\Delta E_F)-E_R]=-(R_2/R_1\Delta E_F)$$

is set to zero (nulled) by adjusting potentiometer 60. Under these conditions, the signal appearing at the output terminal "B" of the second operational amplifier is $-(-E_R)=E_R$. If the two channel signals at the outputs of the full-wave rectifiers are essentially identical (but of opposite polarity) which condition must be obtained by mechanically adjusting the length of the gaps between the reference transmitter/receiver pair and the box transmitter/receiver pair, the signal at the output "B" of amplifier 68 will be $E_R$ and the signal at common point "D" will be zero. This condition of balance will also be true for the various combinations of (N−1) pouches placed in the box channel and the normal two layers of foil placed in the reference channel. This balanced condition represents a missing pouch since N pouches, i.e., one pouch more than (N−1), will cause the signal at "C" to be less negative (due to more field absorption) and the signal at "D" accordingly more positive, and is the normal system output; that is, a change from unbalanced to balanced represents a missing pouch.

Such a change is sensed by applying the signal at point "B" through a 15K ohm resistor 74 and applying the signal at point "C" through a 15K ohm resistor 76 to a common junction point "D", which is bypassed for A.C. signals to ground by a capacitor 78, typically having a value of 0.1 microforad. The signals at points "B" and "C" being of opposite polarity, the signal produced at point "D" represents their difference. It will be noted that the signal component $\Delta E_F$ in the signal produced at the output "A" of amplifier 54 is multiplied by the factor $R_2/R_1$, namely, the ratio of the values of the feedback and input resistors of the amplifier, thereby automatically compensating the reference signal produced at point "B" for changes in foil thickness. Representing the ratio $R_2/R_1$ as (N−1), where N is the desired number of pouches in a box, the user can dial in the desired number by adjusting the position of the wiper of potentiometer 64 to adjust the resistance of resistor $R_2$ to have a value at which there is zero difference between the signals at points "B" and "C" for the (N−1) condition. If the signal at "C" equals the reference signal at point "B", signifying that a box contains one less than the desired number of pouches (i.e., N−1), a rejection signal is generated at point "D" which can be used to trigger a rejection mechanism for removing the incorrect count box from the conveyor.

The described circuit is designed to be armed when the leading edge of a sealed box carried on the conveyor contacts a sensor, such as a microswitch. The microswitch is so positioned as to enable the comparator at approximately one-half the width of the box downstream from the leading edge of the box, at which point the transmitter/receiver pair is at the geometric center of the box, and to be reset to the unarmed condition when the sensor detects the trailing edge of the box. The system is adapted for use with either stepped or continuous motion packaging machines because an open top trough 15 is always present at the upstream detection point regardless of the timing of the strobe of the filled boxes.

Figure 3:
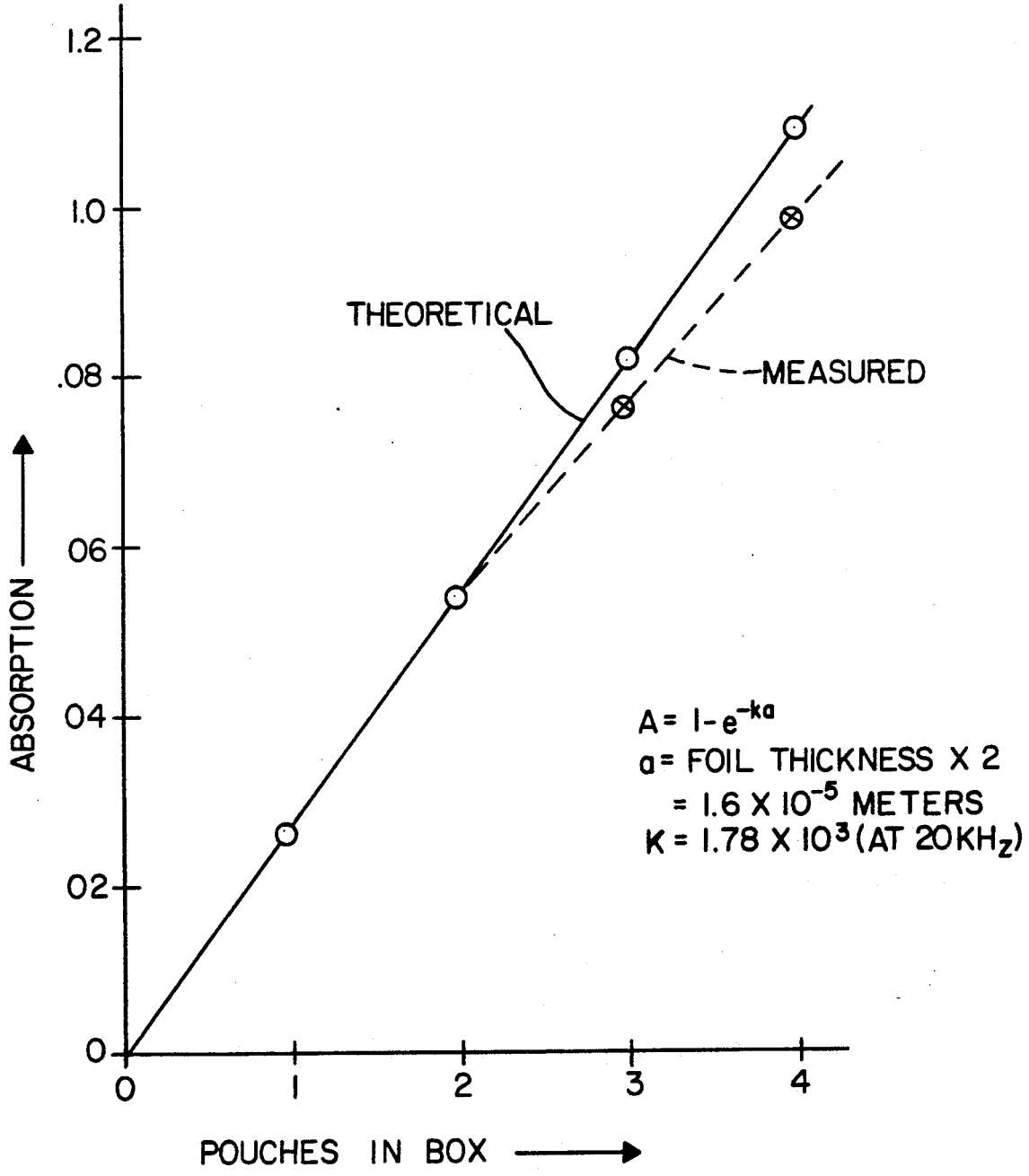
FIG. 3 is a graph which compares the absorption of foil pouches as measured by the system of FIG. 2 against the theoretical absorption.

It will be evident from the graph of FIG. 3 that magnetic field absorption by two layers of pouch foil having a combined thickness of $a=1.6\times10^{-5}$ meters, as measured by the described differential pouch detector, closely approximates the theoretical value $A=1-e^{-ka}$, where $k=1.78\times10^{3}$ for the measured foil at a radiation frequency of 20 KHz. In the cases of one or two pouches per box, the measured absorption equalled the theoretical, and while the measured was somewhat less than the theoretical in the cases of three or four pouches per box, the difference is not so significant as to affect the ability of the system to reliably detect a missing pouch.

While the foregoing describes a preferred embodiment of the invention, it will now be apparent that changes may be made in the pouch detector circuit without departing from the spirit of the invention. For example, although the invention has been described in a food packaging context, it has applicability in the packaging of a variety of products other than food. Such changes are intended to be included in the meaning and range of equivalents of the appended claims.

I claim:

1. In a process for producing boxes of a product, each box to contain a desired number of pouches containing a measured quantity of a product, wherein the pouches are formed upstream from a monitoring station at which boxes containing filled pouches are monitored prior to being transported to a packaging station, a method for detecting whether each box transported from said monitoring station contains the desired number of pouches, said method comprising the steps of:

applying like alternating magnetic fields through two thicknesses of the foil used to form the pouches and through each box passing said monitoring station;

separately detecting the field absorptions of the two thicknesses of foil and of each box and producing first and second signals having amplitudes respectively proportional to the thickness of the foil used to form the pouches and the number of pouches in a box;

multiplying said first signal by (N−1), where N is said desired number and producing a reference signal; and comparing the amplitudes of said second signal and said reference signal and generating a rejection signal if the comparison indicates that a box does not contain N pouches.

2. Method as defined in claim 1, wherein said pouches are formed by initially folding an elongate strip of foil along its long axis to form a U-shaped trough open at the top and having opposed sides which form the sides of the pouch; and wherein said alternating magnetic field is applied through the U-shaped trough.

3. For a system for producing boxes each to contain a desired selectable number of foil pouches each filled with a product, in which the pouches are formed, upstream from a monitoring station, by initially folding an elongate strip of foil to form an open top U-shaped trough, and boxes containing filled pouches are transported from the monitoring station to a packaging station, apparatus for preventing transport to the packaging station of boxes containing other than said desired number of pouches, said apparatus comprising:

means for separately producing first and second signals respectively having amplitudes proportional to the thickness of the foil used to form said pouches and the number of pouches contained in a box;

means for multiplying said first signal by a factor representative of the desired number of pouches per box less one and producing a reference signal; and means for comparing the amplitudes of said second signal and said reference signal and producing a rejection signal if the comparison indicates that a box does not contain said desired number of pouches for use in preventing its transport to said packaging station.

4. Apparatus as defined in claim 3, wherein said means for producing said first and second signals comprise first and second means for applying like alternating magnetic fields through said U-shaped trough of the foil used to form the pouches and through each box as it passes said monitoring station, respectively, and first and second detector means for detecting the field transmitted through said foil trough and the field transmitted through the pouches contained in a box, respectively.

5. Apparatus as defined in claim 4, wherein each first and second detector means includes means for deriving an alternating voltage having a value proportional to the detected field transmission, and means for rectifying said alternating voltage and producing first and second DC voltage signals of opposite polarity, and wherein said multiplying means includes amplifier means for multiplying said first DC signal by the factor (N−1), where N is the desired number of pouches per box.

6. Apparatus as defined in claim 5, wherein said amplifier means comprises a first operational amplifier having a first input terminal connected to receive said first DC signal, an output terminal, and a feedback circuit connected from the output terminal to said first input terminal and including variable resistor means for selectively adjusting the gain of said first operational amplifier for selecting the value of N, a second operational amplifier having a first input terminal connected to receive signals produced at the output terminal of said first operational amplifier, an output terminal, and a feedback circuit connected from the output terminal to said first input terminal, and means including a source of reference DC potential and circuit means for applying a selectively adjustable reference DC potential to the first input terminal of said first and second operational amplifiers for adjusting said first operational amplifier to produce zero output in the absence of foil at either of said detector means and said second operational amplifier to produce at its output terminal a DC voltage equal in amplitude to the adjusted value of the reference DC potential.

7. For use in a packaging system for producing boxes of foil pouches, each box to contain a desired selectable number of filled pouches, in which the pouches are formed, upstream from a monitoring station, by initially folding an elongate strip of foil of variable thickness to form a U-shaped trough, and boxes containing filled pouches are transported from the monitoring station to a packaging station, a system for identifying boxes which do not contain a selected desired number of pouches, said system comprising:

first and second transmitter means for respectively applying like alternating magnetic fields through said trough of foil used to form said pouches and through each box as it passes said monitoring station;

first and second detector means for respectively detecting the field transmitted through said foil trough and through the pouches contained in a pouch and for producing in response thereto first and second DC voltage signals having amplitudes proportional to the thickness of the foil used to form said pouches and the number of pouches contained in a box, respectively;

amplifier means including means for multiplying said first DC voltage signal by (N−1), where N is said selected desired number of pouches per box, and for producing a reference D.C. voltage signal compensated for variations in thickness of the foil used to form the pouches; and means for comparing the amplitudes of said second D.C. voltage signal and said reference D.C. voltage signal and producing an output signal indicative of a missing pouch when the amplitude of said second D.C. voltage signal differs from the amplitude of said reference D.C. voltage.

8. System as defined in claim 7, wherein said first and second detector means are arranged to produce first and second D.C. voltage signals of opposite polarity, and wherein said amplifier means comprises:

first operational amplifier means having a first input terminal connected to receive said first D.C. voltage signal, an output terminal, and a feedback circuit connected between the output terminal and said first input terminal and including variable resistor means for selectively adjusting the amplifier gain to a desired value of N;

second operational amplifier means having a first input connected to receive signals produced at the output terminal of said first operational amplifier means, an output terminal, and a feedback circuit connected from the output terminal to said first input terminal; and means including a source of reference D.C. potential and means connected to said source for applying a selectively adjustable reference D.C. potential to said first input terminal of both said operational amplifier means of an amplitude to cause said first operational amplifier means to produce zero output in the absence of foil at either of said detector means and to cause said second operational amplifier means to produce at its output terminal said reference D.C. voltage signal having an amplitude equal to the adjusted value of the reference D.C. potential.

* * * * *

UNITED STATES PATENT AND TRADEMARK OFFICE

CERTIFICATE OF CORRECTION

PATENT NO. : 5,027,577

DATED : July 2, 1991

INVENTOR(S) : Creswick, Norman S.

It is certified that error appears in the above-identified patent and that said Letters Patent is hereby corrected as shown below:

Title page, Item 73, "Thomas J. Lipton Company" should read --Conopco, Inc.--.
Title page, first col., 4th-from-bottom line, "Justus" should read --Justis--.

Signed and Sealed this

Twenty-third Day of February, 1993

*Attest:*

STEPHEN G. KUNIN

*Attesting Officer*

*Acting Commissioner of Patents and Trademarks*